US009834888B2

(12) United States Patent
Keinberger et al.

(10) Patent No.: US 9,834,888 B2
(45) Date of Patent: Dec. 5, 2017

(54) DRAINAGE ELEMENT COMPRISING AN INSERT

(71) Applicant: RÖCHLING LERIPA PAPERTECH GMBH & CO. KG, Österreich (AU)

(72) Inventors: Rüdiger Keinberger, Österreich (AT); Peter Eckerstorfer, Österreich (AT); Markus Ecker, Österreich (AT); Roland Eckerstorfer, Österreich (AT)

( * ) Notice: Subject to any disclaimer, the term of this patent is extended or adjusted under 35 U.S.C. 154(b) by 0 days.

(21) Appl. No.: 15/303,215

(22) PCT Filed: Apr. 14, 2015

(86) PCT No.: PCT/AT2015/050094

§ 371 (c)(1),
(2) Date: Oct. 10, 2016

(87) PCT Pub. No.: WO2015/157787

PCT Pub. Date: Oct. 22, 2015

(65) Prior Publication Data

US 2017/0037571 A1 Feb. 9, 2017

(30) Foreign Application Priority Data

Apr. 15, 2014 (AT) ..... A 50282/2014

(51) Int. Cl.
*D21F 1/52* (2006.01)

(52) U.S. Cl.
CPC ..... *D21F 1/523* (2013.01)

(58) Field of Classification Search
CPC ..... D21F 1/523; D21F 1/52
USPC ..... 162/380
See application file for complete search history.

(56) References Cited

U.S. PATENT DOCUMENTS 3,365,359 A * 1/1968 Proulx ..... D21F 1/523 162/363
3,404,066 A * 10/1968 Francois ..... D21F 1/523 162/363
6,254,729 B1 * 7/2001 Doelle ..... B01D 29/012 162/251
2011/0197354 A1 * 8/2011 Wedi ..... A47K 3/40 4/613

FOREIGN PATENT DOCUMENTS

CA 2273674 * 9/1998
DE 1761174 * 2/1958

* cited by examiner

*Primary Examiner* — Mark Halpern
(74) *Attorney, Agent, or Firm* — FisherBroyles, LLP; Anthony J. DoVale

(57) ABSTRACT

The invention relates to a drainage element (1) from plastic and a process for its production, which features at least one opening (3), in which an insert (2) is placed, whereas insert (2) features a harder surface than drainage element (1), whereas insert (2) features at least one locking projection (2*h*) with locking surface (2*c*) at is outer circumference, and drainage element (1) in opening (3) features at least one latching surface (1*c*), which is formed via a recess in the girthed area of opening (3) and insert (2) can be pressed into surface (3), whereas locking surface (2*c*) of locking projection (2*h*) of insert (2) enjoins the latching surface (1*c*) in placed conditions, so that insert (2) is positively secured against pulling out in opening (3) of drainage element (1).

19 Claims, 5 Drawing Sheets

DRAINAGE ELEMENT COMPRISING AN INSERT

Figure 1:
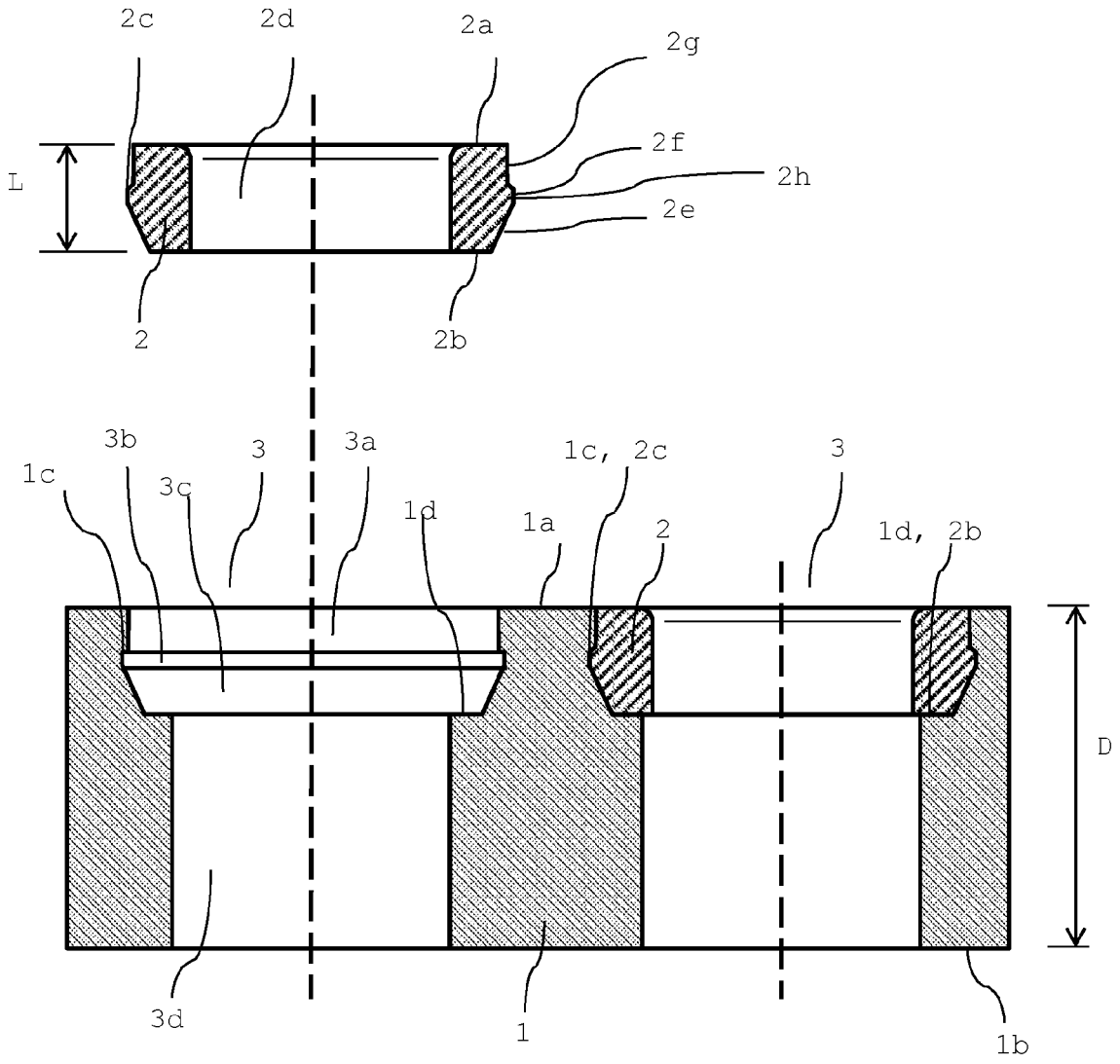

This application is a 371 of PCT/AT2015/050094 filed 14 Apr. 2015

The invention relates to a drainage element from plastics featuring inserts, in particular ceramic inserts.

A drainage system is used in paper machines as well as cardboard, pulp and tissue machines for fiber suspension drainage. The present insert and/or ceramic insert is used in particular for drainage elements of suction boxes (vacuum and low pressure exhausters). The drainage element for the upper surface (lid, cover) of suction box is called suction box cover. For mounting, the underside of drainage element normally has two or more grooves for receiving the suction box T-tracks. The suction box is part of the paper machine sieve section. The fiber suspension of the upper side of a circumferential, continuous sieve from plastic or metal is mounted to the sieve section. This sieve's underside floats over the drainage element. The drainage element has openings, which extract liquid via the application of fiber suspension negative pressure throughout the sieve.

Since the sieve is pressed against the drainage element due to the negative pressure, the drainage element must be extremely smooth and wear-resistant, thus minimizing the wear of the sieve and the drainage element itself.

Very hard materials are therefore best suited for the drainage element. According to the state-of-the-art, it has been a practice to produce drainage elements entirely from ceramic or plastic, such as fiber-reinforced plastic (FRP), or e.g. steel with ceramic coating. It has also been a practice to mount ceramic bars or ceramic segments to beams, especially longitudinal T-tracks from plastic or steel.

Especially advantageous has been the perforated coating for drainage elements where the drainage element itself has many openings, allowing to achieve the best possible drainage, since the perforated coating has the greatest open surface, compared to other designs, and the perforated surface has a more even and gentle drainage profile. The perforated design can either consist of openings on a drainage element surface entirely consisting of either ceramic or plastic.

Due to its great hardness and the very smooth surface, the ceramic version has the advantage of very little wear. The ceramic version has the disadvantage that large elements from ceramic are expensive and difficult to produce. Furthermore, if an element gets damaged, the entire element requires replacement.

The plastic version has the advantage that it is more affordable and easier to producer while having the disadvantage of lower hardness and therefore greater wear than the ceramic version.

Drainage systems have therefore been developed that feature surfaces from different materials, especially plastic and ceramic, thus combining their advantages.

U.S. Pat. No. 3,404,066 A shows a drainage element consisting of a hardwood board entirely covering the suction box. The board is perforated serving to allow liquids to enter the suction box. In order to minimize the wear of the hardwood board hole edge, it has been proposed to insert hollow cylindrical ceramic inserts (e.g. general inserts with great hardness or inserts coated with hard material) into these perforations. To this end, the perforations feature two cylindrical areas, whereas the cylindrical area facing the sieve features the same diameter as the hollow cylinder of the ceramic insert while the lower cylindrical area has the same diameter as the interior diameter of the ceramic insert. An epoxy glue serves to attach the ceramic insert to the perforation.

CA 2273674 A1 features a drainage element consisting of one plastic board, preferably polyethylene. The board features openings, especially longitudinal openings. At the upper periphery, the opening features a continuous belt from a harder material, especially ceramic, so that the material forms the upper edge of the opening, whereas this edge is preferably produced in a rounded manner. The continuous belt itself preferably features a squared cross section, whereas a circular cross section of the openings results in a ceramic sleeve, as was the case in previously quoted U.S. Pat. No. 3,404,066 A. The continuous belt can also feature a round, oval or trapezoid cross section.

DE 1761174 A1 features a drainage system from plastic that can integrate various ceramic inserts. The element uses inserts enclosing an opening of the drainage element while featuring longitudinal inserts that are embedded into the plastic material. The inserts enclosing the openings are essentially produced as detailed in above patents. The longitudinal inserts a prismatic with a trapezoid base, whereas the smaller of the two parallel lateral areas of the trapezoid prism shows upwards so that the inserts are interlock with the plastic. For producing the drainage elements with openings, it has been proposed to place the inserts enclosing the openings at the bottom of a mold or sinter form and to enclose it with plastic. In order to make the inserts height-adjustable, it has been proposed to equip cylindrical wood inserts with a thread so that movable inserts of a different form can be placed into the openings.

The disadvantage of the state-of-the-art is that the inserts are kept in the opening purely through gravity and/or suction, gluing or screwing. The gravity method has the disadvantage that the inserts can fall out of the openings either specifically during transport or when demounting the drainage element. The disadvantage of gluing is that the drainage elements cannot be removed, or only with great effort, from the drainage element. Screwing has the disadvantage that the inserts and/or drainage element requires significant additional processing, since additional openings, inclusions and mounts are required for the screws. Since the screws are generally only accessible from the underside of the drainage element, demounting the inserts is complicated.

When recasting the inserts into the form using plastic, it is possible to positively embed the inserts. Yet this procedure and production process however feature significant disadvantages. Due to the positive embedding via recasting with plastic, inserts cannot be exchanged when damaged or worn. When equipping the inserts with threads, exchangeability is ensured yet the insert features a complex form and sieve vibrations and friction forces can lead to unwanted changes in height.

The production process consisting of placing the inserts into a mold or sinter form and the ensuing enclosure with plastic have the significant disadvantage that due to the foreign body inside the form, even curing of the plastic is more difficult to achieve, which in turn can result in tensions inside the plastic element and/or insert. This will have negative effects on the durability of the drainage element and/or insert. Furthermore, complicated molds are required since mounting elements for attaching the inserts to the mold are required.

The task underlying the invention consists in achieving a positive connection of the insert inside the drainage element plastic while avoiding above disadvantages.

For solving the task, we suggest equipping the insert with at least one fixing element that acts as a barb or similar to a barb, whereas the fixing element engages a fixing area inside the opening of the drainage element during insert placement.

The process according to the invention for producing a strainless drainage element with positively mounted ceramic inserts consists in sintering a board from plastic, preferably ultra high-molecular polyethylene, in a first step.

A machining process involving in particular milling and/or boring will provide openings for this board. In an area at a certain distance from the board surface, the openings feature a partial section with greater cross section and/or greater diameter. The ceramic inserts produced according to known processes (e.g. sintering potentially following by grinding) feature an enlarged cross section and/or diameter in an area situated at a certain distance from the insert covers. The enlarged cross section and/or diameter of the insert is somewhat larger than the cross section and/or diameter of the partial area of the opening, which enjoins the partial section of the opening and the larger cross section and/or diameter facing the surface.

One insert respectively is pressed into one respective opening of the drainage element until the enlarged area of the insert engages the enlarged area of the opening. At the partial area of the opening, the girth area(s) of the insert will be fully enclosed by the drainage element plastic.

Advantages of the present invention include

That the drainage element consists of a strainlessly produced plastic board,

That the inserts can be positively inserted into the drainage element openings,

That the inserts are secured against falling out and vertical shifts

That the quick exchange of individual inserts is nevertheless possible

On the surface with which it enters into contact with the sieve, the insert preferably features a ceramic surface or a ceramic insert, whereas the rest of the insert preferably consists of steel.

Particularly preferably, the insert consists entirely of technical ceramic.

Preferably, the openings will extend throughout the entire depth of the drainage element.

Preferably, the openings are at an angle of 90° relative to the drainage element surface.

Preferably, the insert itself features an opening stretching across the entire insert length.

Preferably, the insert length is short than the depth of the drainage element.

Preferably, the openings and the inserts only feature circular cross sections.

Preferably, the drainage element has been produced as described in the process according to the invention.

An insert according to the invention could however be used according to the invention in case of a differently produced drainage element, provided that it features at least one opening according to the invention.

The drainage element preferably consists of one wear-resistant plastic such as fiber-reinforced plastic, or polyethylene.

The figures below serve to illustrate the invention:

FIG. 1: Illustrates a particularly preferred drainage element according to the invention (lateral sectional view) with one placed insert on one awaiting placement.

FIG. 2: FIGS. 2*a*, 2*b*, 2*c* and 2*d* illustrate drainage elements according to the invention (viewed from above).

FIG. 3: FIGS. 3*a*, 3*b*, 3*c* and 3*d* each illustrate an insert according to the invention, (lateral sectional view and from above)

Figure 4:
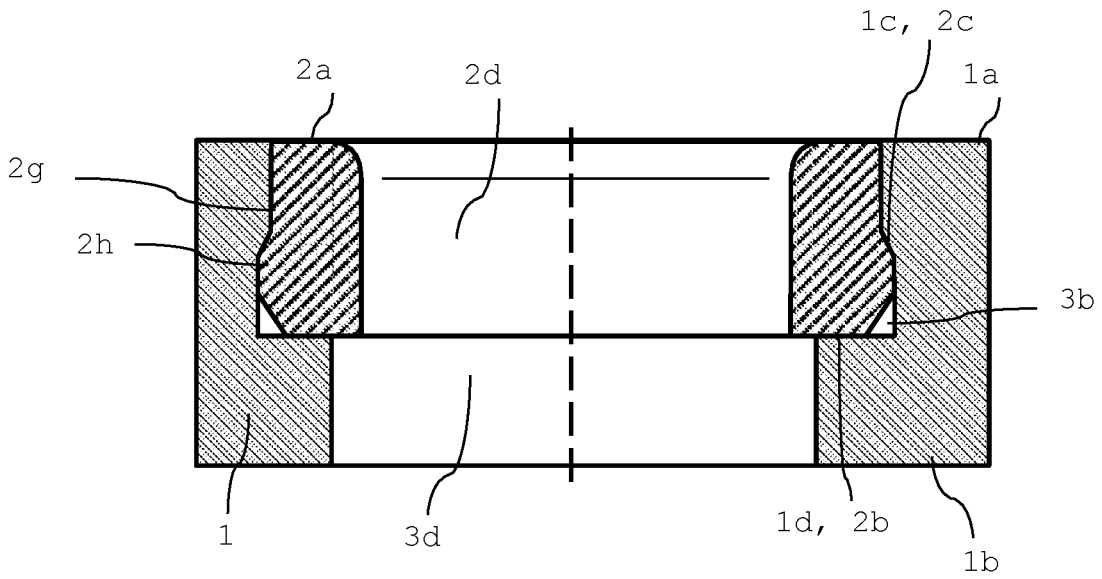

FIG. 4: Illustrates one drainage element with an easily removable insert (lateral sectional view).

Figure 5:
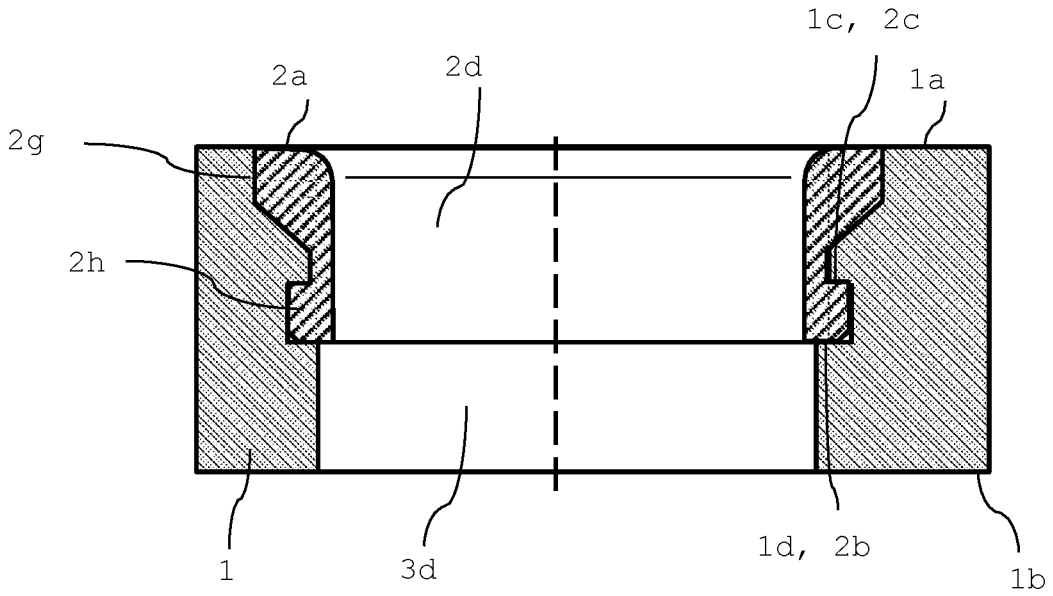

FIG. 5: Illustrates a drainage element with insert (lateral sectional view), whereas the drainage element has a funnel-shaped press-in area.

Figure 6A:
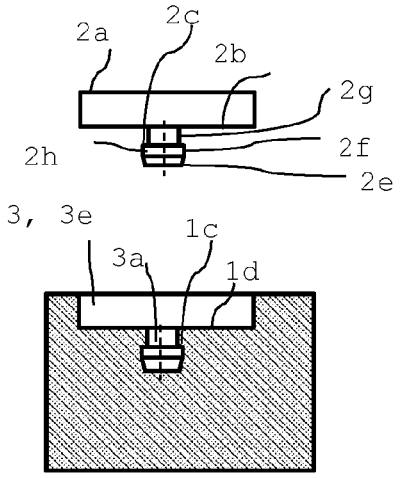
Figure 6B:
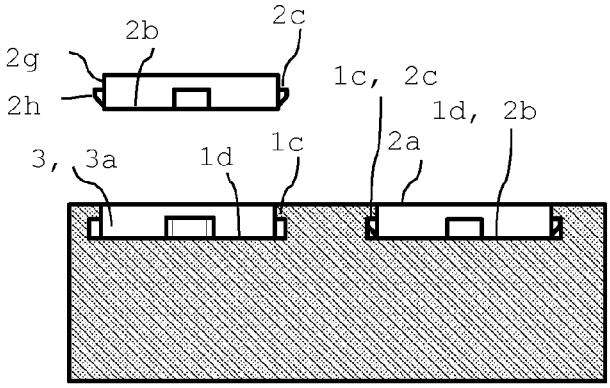

FIG. 6: FIGS. 6*a* and 6*b* have drainage elements (lateral sectional view) with inserts and without openings.

Figure 7:
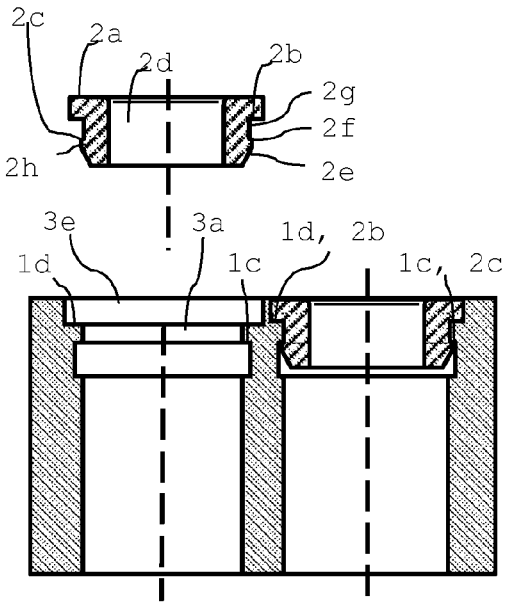

FIG. 7: Illustrates a drainage element with insert, which has an arbitrarily formed cover surface (lateral sectional view).

Figure 8:
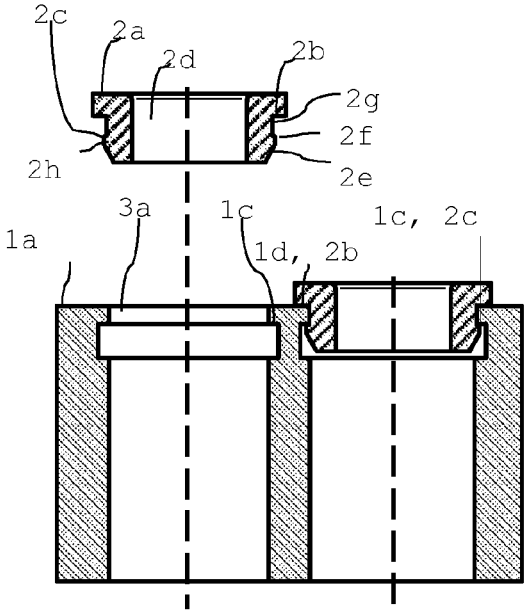

FIG. 8: Illustrates a drainage element with insert, whose sliding surface protrudes from the cover area of the drainage element (lateral sectional view).

FIG. 1 illustrates a drainage element 1 according the invention, featuring two inserts 2, whereas drainage element 1 has two openings 3. The upper area of the drainage element 1, above which the sieve slides, will be called cover surface 1*a*; the lower surface facing the interior of the suction box, will be called base surface 1*b*.

In this example, opening 3 features a circular cross section in each section. Furthermore, two inserts 2 are shown, whereas one of them is placed into opening 3.

Opening 3 has at least two areas with different diameters. In the present example, opening 3 has four areas with different diameters.

Enjoining cover surface 1*a*, opening 3 has a cylindrical area, which serves as fitting for insert 2. This area will be called fitting opening 3*a*. The fitting between insert 2 and cover element 1 is chosen as to achieve a grooveless transition from cover surface 1*a* to sliding area 2*a* of insert 2.

Opening 3, following fitting opening 3*a*, is followed by an area with a larger diameter than that of fitting opening 3*a*. This area serves to receive the fixing element of insert 2, hereafter called receiving element 3*b*. Due to the sudden increase of fitting opening 3*a*'s diameter relative to reception opening 3*b*, a circular surface results in cover element 1, which is parallel to cover surface 1*a*. This circular surface will be called latching surface 1*c* hereafter. The reception opening 3*b* forms a circular recess in the girth area of opening 3. This recess is at a distance of the cover surface 1*a*.

At its bottom end, reception opening 3*b* transitions to a truncated cone-shaped section 3*c* of opening 3. The truncated cone-shaped section 3*c* results from production due to the use of a truncated cone-shaped cutter. When using a cylindrical cutter, it can also be formed cylindrically in area of opening 3.

The truncated cone-shaped section 3*c* features a sudden decrease of its diameter, forming a circular contact surface 1*d* on which insert 2 is supported with its lower support surface 2*b*. Insert 2 and its areas 2*c*, 2*b* are fitted into areas 1*c*, 1*d* of the drainage element so that no vertical movement of insert 2 is possible.

At the lower end of the truncated cone-shaped section 3*c*, passage 3*d* starts, which stretches to the base area 1*b* of drainage element 1.

Insert 2 features approximately a hollow cylindrical form with a mainly constant interior diameter of interior opening 2*d*. Insert 2 preferably features a rounding or a phase at the upper edge of insert opening 2*d*. The cover surface of the hollow cylinder of insert 2 over which the sieve flows will be called sliding surface 2*a* hereafter and basic surface of the hollow cylinder supported by contact surface 1*d*, as support surface 2*b*. The support surface 2*b* has a smaller exterior diameter than opening 3*a*.

Followed by support surface 2*b* is a press-in chamfer and/or press-in cone 2*e*, for which the exterior diameter of insert 2 continuously increases until its diameter exceeds the diameter of fitting opening 3*a*. Press-in cone 2*e* is following by short section 2*f* with constant diameter, which exclusively and suddenly transitions to fitting section 2*g*, thus forming a circular locking surface 2*c*, oriented parallel to floating surface 2*a* and parallel to support surface 2*b*.

When inserting insert 2, press-in cone 2*e* can initially be easily inserted into opening 3*a* until its diameter exceeds that of opening 3*a*. The required force for pressing in increases continuously until the short area 2*f* reaches fitting opening 3*a* along which it is pushed downward at continuous force. As soon as the short section 2*f* has passed fitting opening 3*a*, short section 2*f* enters reception opening 3*b*, which has the same diameter as short section 2*f*. In this position, the insert is fitted into opening 3 vertically through areas 2*c*, 2*b* and, horizontally, through fitting section 2*g*. This averts vertical or horizontal movements of insert 2. Locking surface 2*c* and protruding part of short area 2*f* and press-in cone 2*e*, protruding over fitted section 2*g*, form locking projection 2*h*.

Locking projection 2*h* can, as described above, stretch across entire circumference of insert 2 or merely across one or several partial areas of insert 2's circumference. The same applies to the reception opening 3*b*.

The interior diameter of insert 2 is for example 14 mmm, the exterior diameter approx. 20 mm. Thickness D of drainage element 1 is e.g. 40 mm. Length L of the insert is e.g. approx. 7 mm. The width of the circular locking surface 2*c* is approx. 0.5 mm. The width of circular locking surface 2*c* is approx. 0.5 mm. The width of the circular blocked are 2*c* is dependent on the elasticity and/or hardness of drainage element 1's plastic throughout. The harder the plastic, the lower the necessary width of locking surface 2*c*.

Drainage element 1 can be produced using the long-term inter-press process as 12*m* cover or bar without weld seam and with as a strainless structure. The width of drainage element 1 with seven parallel rows of openings 3 is e.g. 220 mm. The width of the drainage element 1 is the extend of drainage element 1 along the sieve. The width of drainage element 1 can also be chosen to be greater (or smaller); the width is for example greater than 500 mm, whereas the support must be carried out via a substructure of a grid of approx. 250 mm. This support consists in a mount to the drainage element 1 to be designed as to allow unrestricted expansion to drainage element 1 (T-track, angle bar, dovetail guide, screws in elongated holes).

According to the invention, it is also possible that drainage element 1 is not made from a continuous board but consists of various boards and/or drainage elements 1 (according to the invention) welded to each other or mounted in longitudinal or latitudinal direction alongside the sieve. In such event, drainage element 1 according to the invention will only cover a partial area of the sieve, for example. A drainage element 1 according to the invention can have any possible form, whereas the form of a rectangular board is advantageous in most cases.

The resistance that insert 2 features against the withdrawal of drainage element 1 can be set across the width of the circular locking surface 2*c* and/or its inclination toward the cover surface 1*a*, and/or sliding surface 2*a*. However, changing the inclination of locking surface 2*c* has no impact on the necessary press-in force for placing insert 2.

If the locking surface 2*c*, starting from its joint edge with fitting cylinder 2*g* is inclined toward cover surface 1*a*, locking projection 2*h* forms a barb. This latter hooks into the plastic of drainage element 1 when attempting to pull out insert 2. It is then not possible to remove insert 2 without its destruction.

If locking surface 2*c*, starting with its joined surface with fitting cylinder 2*g*, is facing away form cover surface 1*a*, locking surface 2*c* forms a truncated cone-shaped locking projection 2*h*. If that truncated cone has for example the same inclination as press-in cone 2*e*, pulling out will require the same force as pressing in insert 2. Such an insert 2 can, wherever necessary, be removed without destruction and replaced by a new insert 2, or it can be used for another drainage element 1.

The invention also makes it possible to retrofit already-existing massive plastic drainage elements with inserts 2, via boring and milling of the fitting opening 3*a* and milling of reception opening 3*b*.

Figure 2A:
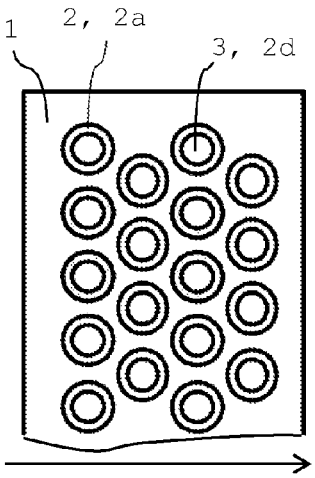
Figure 2B:
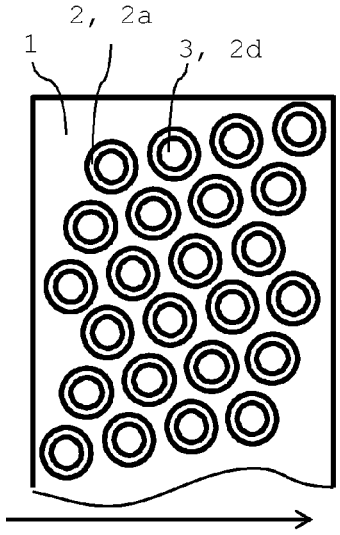

FIG. 2*a*, FIG. 2*b*, FIG. 2*c* and FIG. 2*d* show drainage elements 1 according to the invention and from above. Their openings 3 feature inserts 2. Drainage element 1 has a number of openings 3 throughout. Preferably, it features several rows of openings 3, whereas openings 3 are offset to one another, as shown in FIG. 2*a*. In FIG. 2*a*, the rows are at a 90° angle alongside the sieve (indicated via an arrow). As shown in FIG. 2*b*, the rows can also run diagonally to the direction of the sieve. Openings 3 and inserts 2 shown in FIGS. 2*a* and 2*b* feature circular cross sections. Inserts 2 can be designed acc. to one of the examples of FIG. 3*a*, FIG. 3*b* and FIG. 3*c*. Insert 2 of FIG. 3*a* has a locking protrusion 2*h* along running across the entire circumference, resulting in a circular locking surface 2*c*. Inserts 2 of FIG. 3*b* and FIG. 3*c* have four locking protrusions 2*c* distributed evenly across circumference of Insert 2. Inserts 2 of FIGS. 3*a* and 3*b* have press-in cone 2*e*.

Figure 3A:
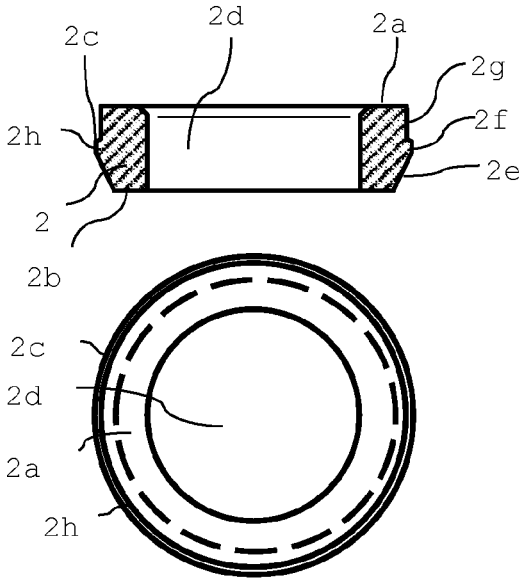
Figure 3B:
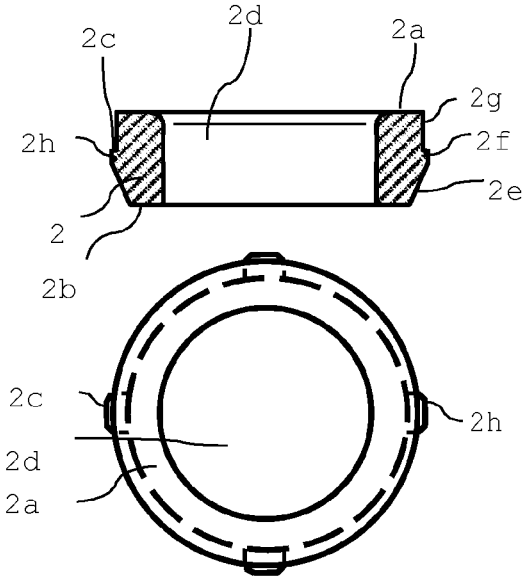
Figure 3C:
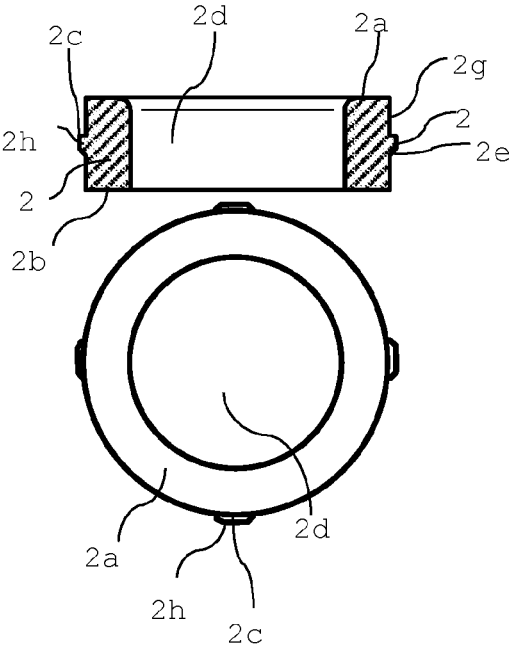

Insert 2 of FIG. 3*c* features essentially a constant circular cross section of which locking projections 2*c* protrude. Locking protrusions 2*c* feature a radially narrowing section at lower part, which assumes function of press-in cone 2*e*. It would of course be conceivable to design a locking projection 2*h* along the entire circumference, i.e. a press-in cone 2*e* with a support surface 2*b*.

Figure 2C:
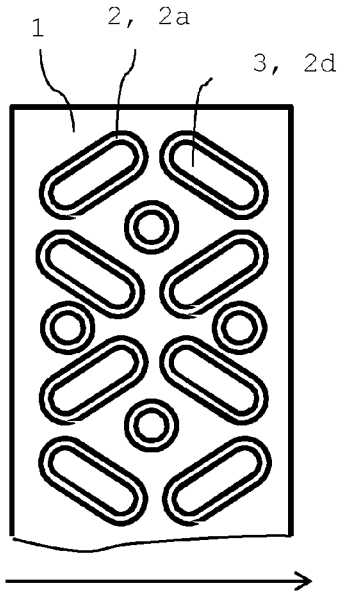
Figure 3D:
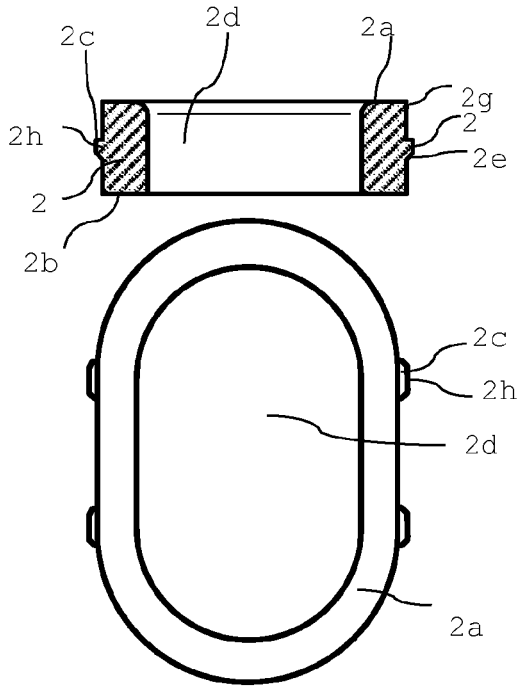

Openings 3 can also be arranged in different patterns along drainage element 1, as shown in FIG. 2*c*. Differently shaped openings 3 and inserts 2 can be used throughout. As shown in FIG. 2*c*, opening 3 can be designed as longitudinal hole, whereas insert 2 features a longitudinal-oval form. The design of a longitudinal-oval insert 2 is shown in FIG. 3*d*. Especially for the cross sections of insert 2 deviating from the circular form and/or ring form, it is advantageous to arrange various locking projections 2*h* across the circumference of insert 2. In such event, it suffices to make the cross section of opening 3 bigger only in those areas, in which the locking projections 2*h* feature in the applied condition.

Figure 2D:
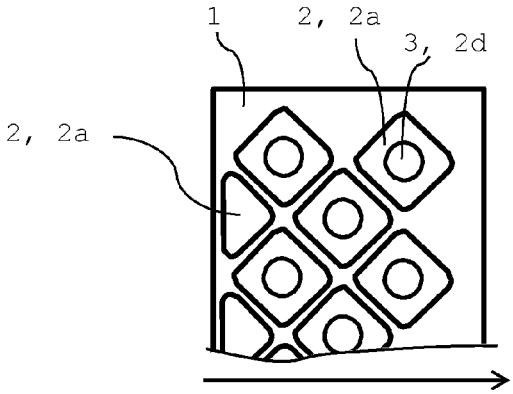

As shown in FIG. 2*d*, inserts 2 can also assume an arbitrarily formed sliding surface 2*a*. Insert 2 on the left edge of drainage element 1 features a triangular form and has no insert opening 2*d*. Such inserts 2 without insert opening 2*d* are considered in the direction of the sieve, preferably along the front and/or back edge of the drainage element 1, since greater wear occurs on the edges than in-between them. Due to wear, the edges gradually wear off. Due to the inserts 2 being at a short distance to the edge of drainage element 1, the extent of the rounding will be limited by the distance of insert 2 to the edge.

Inserts 2 without insert opening 2*d* can be carried out acc. to FIG. 6*a* and FIG. 6*b*. In FIG. 6*a*, the lower end of insert 2 is equipped with a press-in cone 2*e* situated in a cylinder-shaped fitted section 2*g*. This lower part of insert 2 can be designed as in insert 2 of FIG. 1, FIG. 3*a*, FIG. 3*b*, FIG. 3*c*, FIG. 4 and FIG. 5, whereas no insert opening 2*d* exists. The board-shaped upper section connecting to this lower section can have any cross-sectional shape, e.g. triangular as in FIG. 2*d*. This upper section can preferably be inserted in an insertion section 3*e* of opening 3 that is formed in same shape, or it can, analogously to FIG. 8, protrude from cover surface 1*a*.

FIG. 6*b* shows another version of insert 2 without insert opening 2*d*. The board-shaped section is equal to fitted section 2*g*, which is to be inserted in fitted opening 3*a* of same shape. From the circumference of the board-shaped section, one or several locking projections 2*c* protrude, which snap into respective recesses in the girthed area of opening 3. As alternative design, it is conceivable to equip insert 2 of FIG. 6*b* with one or several arbitrarily formed insert openings 2*d* and to equip drainage element 1 with a passage 3*d*.

In addition to inserts 2 without insert opening 2*d*, FIG. 2*d* also shows inserts 2 with a cylinder-shaped insert opening 2*d* and an arbitrarily formed sliding surface 2*a*.

Sliding surface 2*a* of all inserts 2 are designed with rounded edges in 2*d*, as a result in the context of the machined production of openings 3, for which the radii are pre-determined by the cutter sizes. Inserts 2 with almost squared sliding surfaces 2*a* can be shaped advantageously acc. to FIG. 7 and FIG. 8. Throughout, the inserts feature a lower section, which can be designed as shown for insert 2 in FIG. 1, FIG. 3*a*, FIG. 3*b*, FIG. 3*c*, FIG. 4. Fitted section 2*g* is followed by a board-shaped section, which can feature any cross section, forming the sliding surface 2*a* of insert 2.

As shown in FIG. 7, opening 3 preferably features an insert opening 3*e* from the fitted opening 3*a* until cover surface 1*a*. This serves to receive the board-shaped section of insert 2. The lower surface of the board-shaped section forms support surface 2*b*, which sits on contact surface 1*d* of drainage element 1. Contrary to inserts 2 of FIG. 1, support surface 2*b* is above locking surface 2*c*.

As shown in FIG. 8, insert 2 can also be used so that the upper board-shaped section protrudes from cover surface 1*a*. In this event, the cover surface 1*a* simultaneously serves as contact surface 1*d*. As alternative to the insert in FIG. 8, it is conceivable that the upper section is not board-shaped but designed as a spherical segment.

FIG. 4 shows a preferred design of the latching surface 1*c* and the locking surface 2*c*. Locking surface 2*c* of the latching element 2*h* is facing away from sliding surface 2*a* (when considered from fitted section 2*g*), and is placed congruously on latching surface 1*c*. An appropriate tool that moves through opening 2*d* from above, originating from support surface 2*b* protruding from contact surface 1*d*, can pull insert 2 opening 3 (from above). The resistance against pulling out depends on the inclination of locking surface 2*c*.

FIG. 5 shows a design of insert 2 and opening 3 for which insert 2 does not need to feature a press-in cone 2*e* since opening 3 shows a funnel-shaped area, which facilitates the insertion of insert 2.

The description of the illustrations advantageously describes invention characteristics, which can be freely combined by an expert. Differently designed inserts 2 can also be contained in a single drainage element 1.

The invention claimed is:

1. Drainage element comprising a cover surface from plastic with at least one opening wherein at least one insert is placed in said opening wherein said insert has on its upper side a sliding surface with a harder surface than said cover surface of said drainage element, wherein said insert comprises at least one locking projection with one locking surface at its outer circumference, wherein said drainage element comprises at least one latching surface in said opening which is formed via a recess in the girthed area of said opening, wherein said insert can be pressed into said opening, wherein said locking projection of said insert enters said recess of the girthed area of said opening and said locking surface of said locking projection of said insert is engaged with said latching surface of said opening from a direction opposite of that direction from which said insert was pressed into said opening.

2. Drainage element as claimed in claim 1, wherein said drainage element further comprises a contact surface and said insert further comprises a support surface and wherein said support surface of said insert rests against said contact surface from that direction from which said insert was pressed into said opening.

3. Drainage element as claimed in claim 1, wherein said opening further comprises a fitted opening and said insert further comprises a fitted section, wherein said fitted section of said insert is located in said fitted opening of said opening, thus securing the insert against movement in the plane of said cover surface of said drainage element.

4. Drainage element as claimed in claim 3, wherein said fitted section of said insert has a cylindrical form.

5. Drainage element as claimed in claim 3, wherein said insert comprises an area adjoining said fitted section in direction of said sliding surface of said insert and wherein said area has a larger, arbitrarily formed cross section relative to said fitted section.

6. Drainage element as claimed in claim 3, wherein said contact surface of said drainage element is said cover surface of said drainage element.

7. Drainage element as claimed in claim 1, wherein said sliding surface of said insert and said cover surface of said drainage element being situated on same level.

8. Drainage element as claimed in claim 1, wherein said opening leads from said cover surface of said drainage element to a base surface of said drainage element.

9. Drainage element as claimed in claim 8, wherein insert comprises an insert opening, which stretches from said sliding surface of said insert along entire length of said insert.

10. Drainage element as claimed in claim 9, wherein said insert opening and said opening of said drainage element are arranged concentrically and at an angle of 90° to said cover surface of said drainage element.

11. Drainage element as claimed in claim 1, wherein said opening of said drainage element and said insert comprise only circle and ring-shaped cross sections.

12. Drainage element as claimed in claim 1, wherein at least one of said locking projections of said insert comprises a conic and/or or narrowing section on its side facing away from said sliding surface and said locking surface of said insert.

13. Drainage element as claimed in claim 1, wherein said locking surface of said insert is being inclined towards or away from said sliding surface of said insert.

14. Drainage element as claimed in claim 1, wherein said locking projection of said insert stretches along the entire circumference of said insert and wherein said recess of the girthed area of said opening of said drainage element stretches along entire circumference of said opening.

15. Drainage element as claimed in claim 1, wherein said insert comprises various locking projections spread over the circumference of said insert.

16. Drainage element as claimed in claim 1, wherein said insert comprises a truncated cone-shaped section serving as press-in cone at its side facing away from said sliding surface of said insert.

17. Drainage element as claimed in claim 1, wherein said sliding surface of said insert being formed from ceramic or said insert being entirely consisting of ceramic.

18. Drainage element as claimed in claim 1, wherein said drainage element consists entirely of wear-resistant plastic, especially highly molecular polyethylene.

19. Method for producing a drainage element, wherein in a first step said drainage element is produced in the form of a continuous board, especially sintered from ultra-high-molecular polyethylene, wherein in a second step the drainage element is equipped via machining processing with openings and in a third step inserts with hard, wear-resistant surface, especially ceramic inserts, are pressed into said openings, wherein at least one insert comprises at least one locking projection with one locking surface at the outer circumference of said insert, wherein at least one of said openings of said drainage element comprises at least one latching surface, which is formed via a recess in the girthed area of said opening, wherein said locking projection of said insert enters said recess of the girthed area of said opening and said locking surface of said locking projection of said insert is engaged with said latching surface of said opening from a direction opposite of that direction from which said insert was pressed into said opening.

* * * * *